US005309733A

United States Patent [19]

Hayashida et al.

[11] Patent Number: 5,309,733

[45] Date of Patent: May 10, 1994

[54] AIR-CONDITIONING SYSTEM

[75] Inventors: Noriaki Hayashida; Takashi Nakamura; Hidekazu Tani; Tomohiko Kasai; Junichi Kameyama; Shigeo Takata, all of Wakayama, Japan

[73] Assignee: Mitsubishi Denki Kabushiki Kaisha, Tokyo, Japan

[21] Appl. No.: 36,255

[22] Filed: Mar. 24, 1993

Related U.S. Application Data

[62] Division of Ser. No. 814,558, Dec. 30, 1991, Pat. No. 5,237,833.

[30] Foreign Application Priority Data

| | | | |
|---|---|---|---|
| Jan. 10, 1991 | [JP] | Japan | 3-001616 |
| Jan. 21, 1991 | [JP] | Japan | 3-004841 |
| Jan. 28, 1991 | [JP] | Japan | 3-008360 |
| Jan. 31, 1991 | [JP] | Japan | 3-010415 |
| Jan. 31, 1991 | [JP] | Japan | 3-010710 |
| Jan. 31, 1991 | [JP] | Japan | 3-010711 |
| Feb. 5, 1991 | [JP] | Japan | 3-014031 |
| Feb. 5, 1991 | [JP] | Japan | 3-014162 |
| Feb. 5, 1991 | [JP] | Japan | 3-014200 |
| Feb. 20, 1991 | [JP] | Japan | 3-026000 |
| Feb. 20, 1991 | [JP] | Japan | 3-026001 |
| Mar. 28, 1991 | [JP] | Japan | 3-064631 |
| Nov. 15, 1991 | [JP] | Japan | 3-300615 |

[51] Int. Cl.[5] ..... F25B 47/00

[52] U.S. Cl. ..... 62/278; 62/324.6

[58] Field of Search ..... 62/160, 81, 278, 324.6, 62/197

[56] References Cited

U.S. PATENT DOCUMENTS

| | | | |
|---|---|---|---|
| 4,621,505 | 11/1986 | Ares et al. . | |
| 4,760,707 | 8/1988 | Dennis et al. . | |
| 4,799,363 | 1/1989 | Nakamura | 62/160 |
| 5,156,014 | 10/1992 | Nakamura et al. | 62/160 |

FOREIGN PATENT DOCUMENTS

| | | | |
|---|---|---|---|
| 0119024 | 9/1984 | European Pat. Off. . | |
| 2223778 | 9/1990 | Japan | 62/81 |
| 2194651 | 3/1988 | United Kingdom . | |

*Primary Examiner*—William E. Wayner

*Attorney, Agent, or Firm*—Oblon, Spivak, McClelland, Maier & Neustadt

[57] ABSTRACT

An air conditioning system in which a single heat source unit (A) comprising a compressor (1), a four-way valve (2), a heat source unit side heat exchanger (3) and an accumulator (4) is connected to a plurality of indoor units (B, C, D) through a first and a second connection pipes (6, 7). Each indoor unit (B, C, D) comprises a suction air temperature detecting device (50) for detecting a suction air temperature of the indoor unit, an opening degree setting device for setting a minimum valve opening degree of the first flow rate controller 9 in accordance with the difference between the target temperature and the suction air temperature and a first valve opening degree control device (52) for controlling the valve opening degree of the first flow rate controller 9 at a predetermined rate to the minimum valve opening degree. A bypass system is further provided to enable an effective defrost operation.

2 Claims, 10 Drawing Sheets

AIR-CONDITIONING SYSTEM

This is a division of application Ser. No. 07/814,558, filed on Dec. 30, 1991 now U.S. Pat. No. 5,237,833.

BACKGROUND OF THE INVENTION

This invention relates to an air-conditioning system in which a plurality of indoor units are connected to a single heat source unit and particularly to a refrigerant flow rate control unit so that a multi-room heat pump type air conditioning system is provided for selectively operating the respective indoor units in cooling or heating mode of operation, or wherein cooling can be carried out in one or some indoor units while heating can be concurrently carried out in other indoor units.

FIG. 9 is a general schematic diagram illustrating one example of a conventional heat pump type air-conditioning system. In the figure, reference numeral 1 designates a compressor, 2 is a four-way valve, 3 is a heat source unit side heat exchanger, 4 is an accumulator, 5 is an indoor side heat exchanger, 6 is a first connection pipe, 7 is a second connection pipe, and 9 is a first flow rate controller.

The operation of the above-described conventional air-conditioning system will now be described.

In the cooling operation, a high-temperature, high-pressure refrigerant gas supplied from the compressor 1 flows through the four-way valve 2 and is heat-exchanged with air in the heat source unit side heat exchanger 3, where it is condensed into a liquid. Then, the liquid refrigerant is introduced into the indoor unit through the second connection pipe 7, where it is pressure-reduced by the first flow rate controller 9 and heat-exchanged with air in the indoor side heat exchanger 5 to evaporate into a gas thereby cooling the room.

The refrigerant in the gaseous state is then supplied from the first connection pipe 6 to the compressor 1 through the four-way valve 2 and the accumulator 4 to define a circulating cycle for the cooling operation.

In the heating operation, the high-temperature, high-pressure refrigerant gas supplied from the compressor 1 is flowed into the indoor unit through the four-way valve 2 and the first connection pipe 6 so that it is heat-exchanged with the indoor air in the indoor side heat exchanger 5 to be condensed into liquid thereby heating the room.

The refrigerant thus liquidified is pressure-decreased in the first flow rate controller 9 until it is in the low-pressure, gas-liquid phase state and introduced into the heat source unit side heat exchanger 3 through the second connection pipe 7, where it is heat-exchanged with the air to evaporate into a gaseous state, and is returned to the compressor 1 through the four-way valve 2 and the accumulator 4, whereby a circulating cycle is provided for carrying out the heating operation.

FIG. 10 is a general schematic diagram illustrating another example of a conventional heat pump type air-conditioning system, in which reference numeral 24 designates a low-pressure saturation temperature detection means.

In the above conventional air-conditioning system, when the cooling operation is to be carried out, the compressor 1 is controlled in terms of the capacity so that the detected temperature of the low-pressure saturation temperature detecting means 24 is in coincidence with the predetermined value.

However, in the conventional air-conditioning system, all of the indoor units are coincidentally operated in either cooling or heating mode of operation, so that a problem where an area to be cooled is heated and, contrary, where an area to be heated is cooled.

As an improvement of this, an air conditioning system which allows the concurrent cooling and heating operations as illustrated in FIG. 11.

In FIG. 11, A is a heat source unit, B, C and D are indoor units of the same construction and connected in parallel to each other as described later. E is a junction unit comprising therein a first junction portion, a second flow rate controller, a second junction portion, a gas/-liquid separator, a heat exchanger, a third flow rate controller and a fourth flow rate controller.

Reference numeral 20 is a heat source side fan of a variable flow rate for blowing air to the heat source side heat exchanger 3, **6*b*, 6*c* and 6*d* are indoor unit side first connection pipes corresponding to the first connection pipe 6 and connecting the junction unit E to the indoor side heat exchangers 5 of the indoor units B, C and D, respectively, and 7*b*, 7*c* and 7*d* are indoor unit side second connection pipes corresponding to the second connection pipe 7 and connecting the junction unit E to the indoor unit side heat exchangers 5** of the indoor units B, C and D, respectively.

Reference numeral 8 is a three-way switch valve for selectively connecting the indoor unit side first connection pipes **6*b*, 6*c* and 6*d* to either of the first connection pipe 6 or to the second connection pipe 7**.

Reference numeral 9 is a first flow rate controller disposed close to the exchanger 5 and connected to the indoor unit side second connection pipes **7*b*, 7*c* and 7*d* and is controlled by the superheating amount at the outlet side of the indoor unit side heat exchanger 5** in the cooling mode of operation, and is controlled by the subcooling amount in the heating mode of operation.

Reference numeral 10 is a first junction portion including three-way valves 8 connected for switching between the indoor unit side first connection pipes **6*b*, 6*c* and 6*d*, the first connection pipe 6 and the second connection pipe 7**.

Reference numeral 11 is a second junction portion comprising the indoor unit side second connection pipes **7*b*, 7*c* and 7*d*, and the second connection pipe 7**.

Reference numeral 12 designates a gas-liquid separator disposed midpoint in the second connection pipe 7, the gas phase portion thereof being connected to a first opening **8*a* of the three-way valve 8, the liquid phase portion thereof being connected to the second junction portion 11**.

Reference numeral 13 designates a second flow rate controller (an electric expansion valve in this embodiment) connected between the gas-liquid separator 12 and the second junction portion 11.

Reference numeral 14 designates a bypass pipe connecting the second junction portion 11 and the first connection pipe 6, 15 is a third flow rate controller (an electric expansion valve in this embodiment) disposed in the bypass pipe 14, **16*a* is a second heat exchanging portion disposed downstream of the third flow rate controller 15 inserted in the bypass pipe 14 for the heat-exchange in relation to the junctions of the indoor unit side second connection pipes 7*b*, 7*c* and 7*d* in the second junction portion 11**.

**16*b*, 16*c* and 16*d* are third heat exchanging portions disposed downstream of the third flow rate controller 15 inserted in the bypass pipe 14** for the heat-exchange in relation to the junctions of the indoor unit side second connection pipes 7*b*, 7*c* and 7*d* in the second junction portion 11.

Reference numeral 19 is a first heat exchanging portion disposed downstream of the third flow rate controller 15 inserted in the bypass pipe 14 and downstream of the second heat exchanging portion 16*a* for the heat-exchange in relation to the pipe connected between the gas-liquid separator 12 and the second flow rate controller 13, and 17 is a fourth flow rate controller (an electric expansion valve in this embodiment) connected between the second junction portion 11 and the first connection pipe 6.

Reference numeral 32 is a third check valve disposed between the heat source unit side heat exchanger 3 and the second connection pipe 7 for allowing the flow of the refrigerant only from the heat source unit side heat exchanger 3 to the second connection pipe 7.

Reference numeral 33 is a fourth check valve disposed between the four-way valve 2 of the heat source unit A and the first connection pipe 6 for allowing the flow of the refrigerant only from the first connection pipe 6 to the four-way valve 2.

Reference numeral 34 is a fifth check valve disposed between the four-way valve 2 and the second connection pipe 7 for allowing the flow of the refrigerant only from the four-way valve 2 to the second connection pipe 7.

Reference numeral 35 is a sixth check valve disposed between the heat source unit side heat exchanger 3 and the first connection pipe 7 for allowing the flow of the refrigerant only from the first connection pipe 6 to the heat source unit side heat exchanger 3.

The above-described third, fourth, fifth and sixth check valves 32, 33, 34 and 35, respectively, constitutes a flow path change-over unit 40.

Reference numeral 21 designates a takeoff pipe connected at one end thereof to the liquid outlet pipe of the heat source unit side heat exchanger 3 and to the inlet pipe of the accumulator 4, 22 is a throttle disposed in the takeoff pipe 21, and 23 designates a second temperature detection means disposed between the throttle 22 and the inlet pipe of the accumulator of the takeoff pipe 21.

The conventional air-conditioning system capable of a concurrent heating and cooling operation has the above-described construction. Accordingly, when only the cooling operation is being carried out, the high-temperature, high-pressure refrigerant gas supplied from the compressor 1 flows through the four-way valve 2 and is condensed into a liquid in the heat source unit side heat exchanger 3 with the air supplied from the variable capacity heat source unit side fan 20. Then, the liquid refrigerant is introduced into the respective indoor units B, C and D through the third check valve 32, the second connection pipe 7, the gas-liquid separator 12, the second flow rate controller 13, the second junction portion 11 and through the indoor unit side second connection pipes 7*b*, 7*c* and 7*d*.

The refrigerant introduced into the indoor units B, C and D is decreased in pressure by the first flow rate controller 9 controlled by the superheating amount at the outlet of the indoor unit side heat exchanger 5, where it is heat-exchanged in the indoor unit side heat exchanger 5 with the indoor air to be evaporated into a gas to cool the room.

The gaseous refrigerant is flowed through the indoor unit side first connection pipes 6*b*, 6*c* and 6*d*, the three-way change-over valve 8, the first junction portion 10, the first connection pipe 6, the fourth check valve 33, the four-way valve 2 of the heat source unit and the accumulator 4 into the compressor 1 to define a circulating cycle for the cooling operation.

At this time, the first opening 8*a* of the three-way change-over valve 8 is closed while the second opening 8*b* and the third opening 8*c* are opened. At this time, the first connection pipe 6 is at a low pressure and the second connection pipe 7 is at a high pressure, so that the refrigerant inevitably flows toward the third check valve 32 and the fourth check valve 33.

Also, in this cycle, one portion of the refrigerant that passes through the second flow rate controller 13 is introduced into the bypass pipe 14 and is press-reduced in the third flow rate controller 15 and heat-exchanged in the third heat exchanging portions 16*b*, 16*c* and 16*d* in relation to the indoor unit side second connection pipes 7*b*, 7*c* and 7*d* of the second junction portion 11. Thereafter, the heat-exchanging is carried out in the second heat exchanging portion 16*a* in relation to the indoor unit side second connection pipes 7*b*, 7*c* and 7*d* of the second junction portion 11, and a further heat-exchanging is carried out in the first heat exchanging portion 19 in relation to the refrigerant flowing into the second flow rate controller 13 to evaporate the refrigerant, which then is supplied to the first connection pipe 6 and the fourth check valve 33 to be returned into the compressor 1 through the four-way valve 2 of the heat source unit and the accumulator 4.

On the other hand, the refrigerant within the second junction portion 11 which is heat-exchanged and cooled at the first, second and third heat-exchanging portions 19, 16*a*, 16*b*, 16*c* and 16*d* and is introduced into the indoor units B, C and D to be cooled.

In the mode of operation in which cooling is mainly carried out in the concurrent cooling and heating operations, the refrigerant gas supplied from the compressor 1 is flowed into the heat source unit side heat exchanger 3 through the four-way valve 2, where it is heat-exchanged in relation to the air supplied by the variable capacity heat source unit side fan 20 to become a high-temperature and high-pressure gas-liquid phase. At this time, the pressure obtained on the basis of the saturation temperature detected by the second temperature detecting means 23 is used to adjust the air flow rate of the heat source unit side fan 20 and the capacity of the compressor 1.

Thereafter, this refrigerant in the high-temperature, high-pressure gas-liquid phase state is supplied to the gas-liquid separator 12 of the junction unit E through the third check valve 32 and the second connection pipe 7.

Then, the refrigerant is separated into the gaseous refrigerant and the liquid refrigerant, the separated gaseous refrigerant is introduced into the indoor unit D to be heated through the first junction portion 10, the three-way valve 8 and the indoor unit side first connection pipe 6*d*, where it is heat-exchanged in relation to the indoor air in the indoor unit side heat exchanger 5 to be condensed into a liquid to heat the room.

The refrigerant is then controlled by the subcooling amount at the outlet of the indoor unit side heat exchanger 5, flows through the substantially fully opened first flow rate controller 9 where it is slightly pressure-decreased and enters into the second junction portion 11. On the other hand, the liquid refrigerant is supplied to the second junction portion 11 through the second flow rate controller 13, where it is combined with the refrigerant which passes through the indoor unit D to be heated and introduced into each indoor units B and C through the indoor unit side second connection pipes 7*b* and 7*c*. The refrigerant flowed into the respective indoor units B and C is pressure-reduced by the first flow rate controller 9 controlled by the superheating amount at the outlet of the indoor unit side heat exchangers B and C and is heat-exchanged in relation to the indoor air to evaporate into vapor to cool the room.

The vaporized refrigerant then flows through a circulating cycle of the indoor unit side first connection pipes 6*b* and 6*c*, the three-way valve 8 and the first junction portion 10 to be suctioned into the compressor 1 through the first connection pipe 6, the fourth check valve 33, the four-way valve 2 of the heat source unit and the accumulator 4, thereby to carry out the cooling-dominant operation.

The conventional air-conditioning system constructed as above-described has a problem in that, a disturbance of the refrigerant cycle is generated due to the variation in pressure of the refrigeration cycle and a stable detection of the low-pressure saturation temperature in the heat source unit cannot be achieved due to the variation of the indoor cooling load when the operation is cooling only or due to the variation of the indoor cooling load or heating load when the operation is cooling-dominant. When the operation is cooling-dominant, the refrigerant which passed through the heat source unit side heat exchanger becomes vapor-liquid phase state, preventing a stable detection of the saturation temperature of the refrigerant. Alternatively, when the number of indoor units in the cooling operational mode, when the units are started for cooling operation after a long period of stoppage or when the cooling operation is started immediately after heating operation, a large amount of liquid refrigerant stays in the accumulator or the like, so that a vapor-liquid two-phase state due to lack of refrigerant takes place at the inlet of the first flow rate controller 9, increasing the flow path resistance of the first flow rate controller 9, which causes the decrease in refrigerant pressure, the decrease in the refrigerant circulating amount and the decrease in the low pressure saturation temperature whereby the cooling capacity is disadvantageously decreased and the heating and cooling cannot be selectively carried out by each indoor unit and a stable concurrent cooling and heating operation in which some of the indoor units carry out cooling and some other of the indoor units carry out heating.

In particular, when the air-conditioning system is installed in a large-scale building, the air-conditioning load is significantly different between the interior portion and the perimeter portion, and between the general offices and the OA (office automated) room such as a computer room.

SUMMARY OF THE INVENTION

This invention has been made in order to solve the above-discussed problems and has as its object the provision of an air-conditioning system in which the cooling and heating can be selectively carried out for each indoor units or some of the indoor units can be cooling-operated while the other of the indoor units are being heating-operated. A further improvement resides in the provision for a defrosting operation in such a system.

The air-conditioning system according to the invention is provided with a suction air temperature detecting means for detecting a suction air temperature of the plurality of indoor units, opening degree setting means for setting a minimum valve opening degree of the first flow rate controller in response to a difference between a detected temperature and a predetermined target temperature, and first valve opening degree controlling means for controlling the valve opening degree in response to the above temperature difference.

Thus air-conditioning system of the present invention is provided with a first bypass circuit which is connected between the first connection pipe and the second connection pipe and which is opened during the defrosting operation.

In air-conditioning system of the invention, a first bypass circuit which opens during the defrosting operation allows, immediately after the initiation of the defrosting operation, the high-temperature and high-pressure vapor refrigerant filled in a second connection pipe to flow into the accumulator. In addition, high-temperature and high-pressure vapor refrigerant supplied from the compressor to the heat source unit side heat exchanger through a four-way valve is heat-exchanged in the heat source unit side heat exchanger in relation to the frost, and turned into liquid. The refrigerant is then combined with the high-temperature, high-pressure vapor refrigerant in the second connection pipe, is supplied to the accumulator through the four-way valve, so that the refrigerant in the low-pressure, vapor-liquid two-phase state is suctioned from the accumulator into the compressor, where it is completely vaporized.

In the heating only operation, the refrigerant is introduced into each indoor unit through a first junction unit to heat the room and returns to the heat source unit from the second junction unit.

In the cooling only operation, the refrigerant is heat-exchanged in first and second heat exchanging elements, further heat-exchanged in the third heat exchanging element through the changer-over valve, and is introduced into each indoor unit through the second junction unit to cool the room and returns to the heat source unit from the first junction unit.

In the defrosting operation, the refrigerant is heat-exchanged at the first and the second heat exchanging elements, further heat-exchanged at the third heat exchanging element through the change-over valve, and is introduced into each indoor unit through the second junction unit t return to the heat source unit through the first junction unit.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

The description of the embodiments of the air-conditioning system of the present invention will now be made in terms of the drawings.

Figure 1:
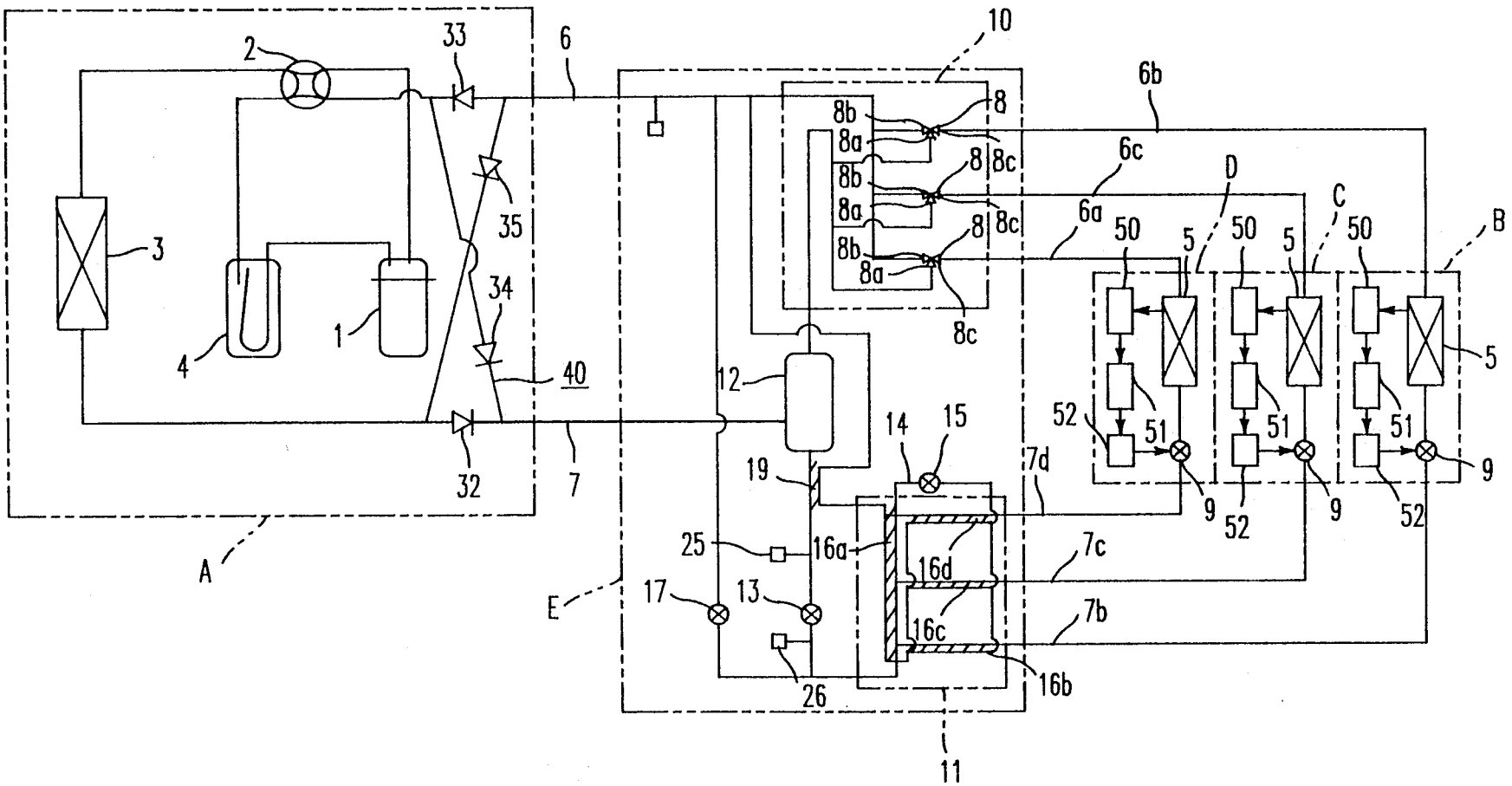
FIG. 1 is a general schematic diagram illustrating the refrigeration lines of the air-conditioning system of the present invention.
Figure 2:
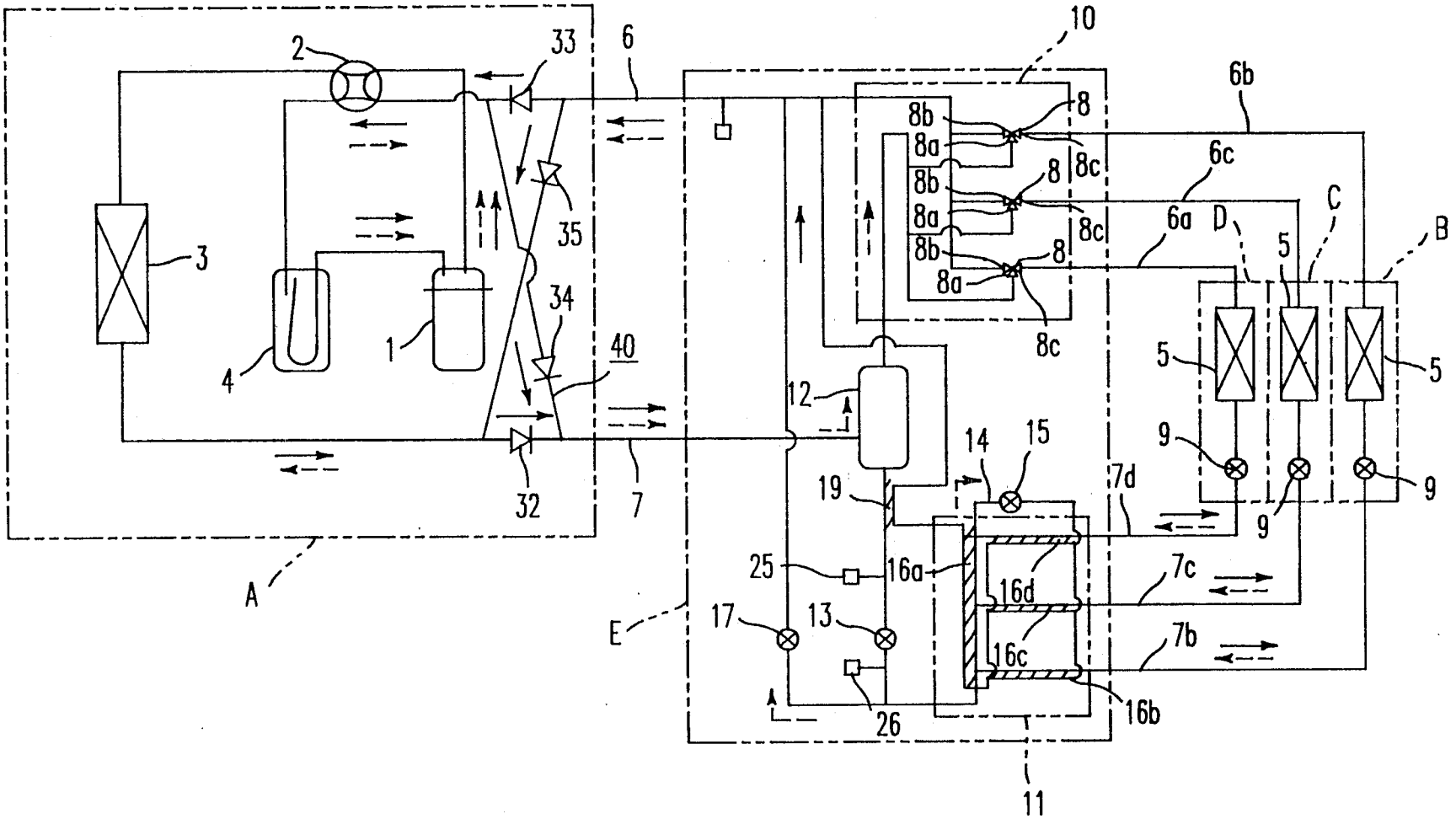
FIG. 2 is a refrigerant circuit diagram for explaining the operation states for cooling only and heating only in the air-conditioning system of the present invention.
Figure 3:
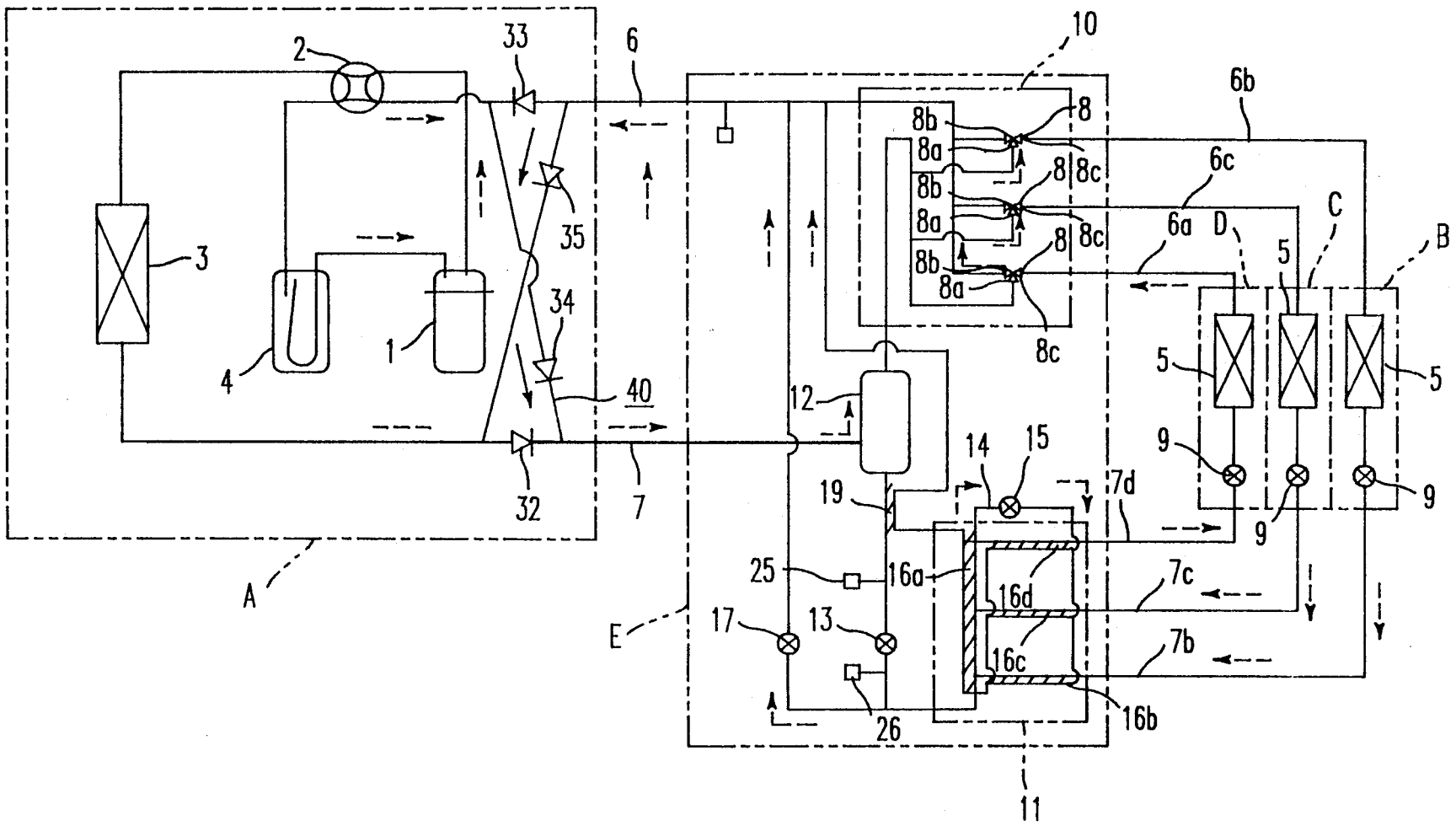
FIG. 3 is refrigerant circuit diagram for explaining the operational state for the heating-dominant operation in the air-conditioning system of the present invention.
Figure 4:
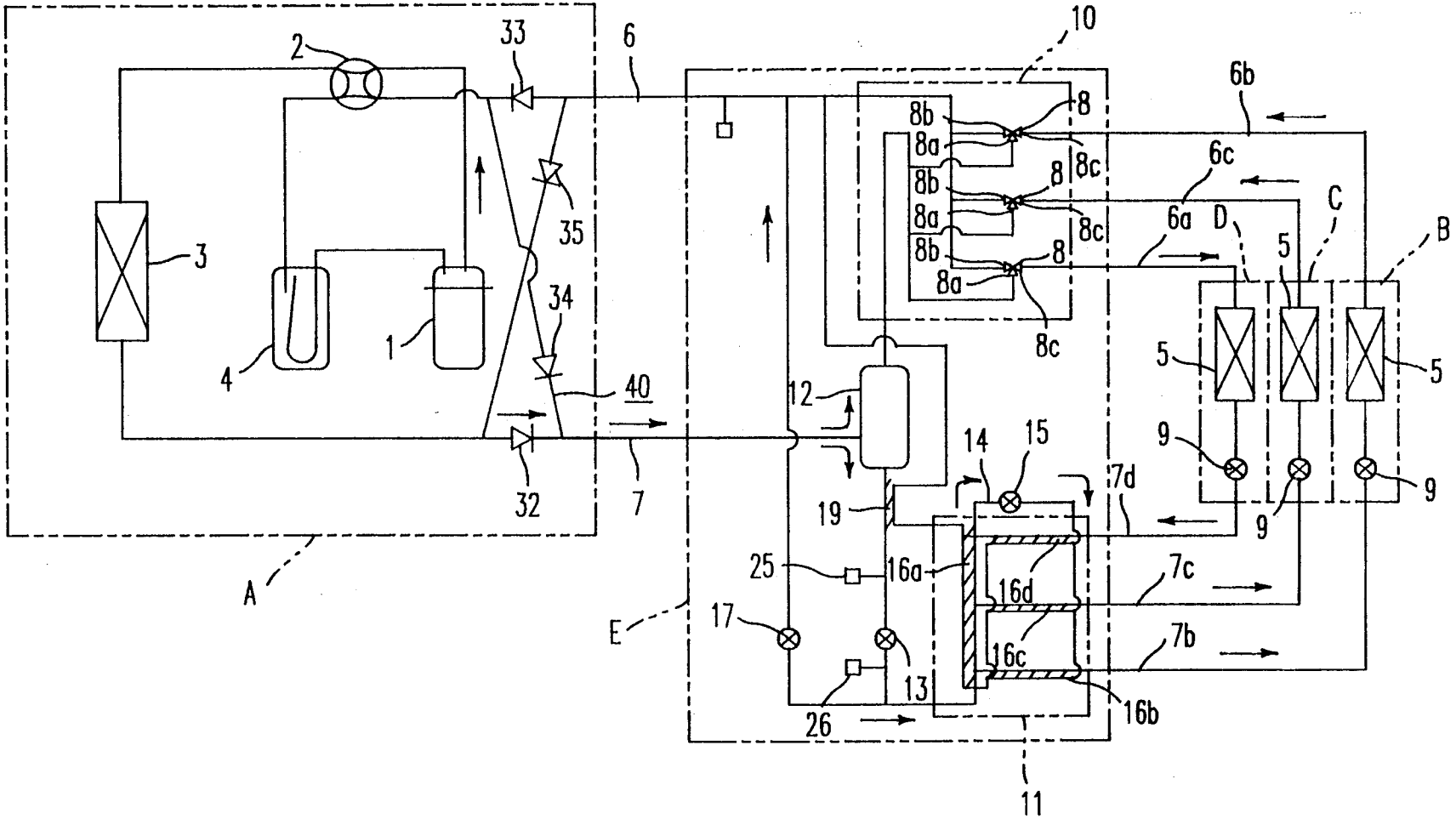
FIG. 4 is a refrigerant circuit diagram for explaining the operational state for the cooling dominant operation in the air-conditioning system of the present invention.

FIG. 1 is a general schematic diagram of the refrigerant lines in a system of the present invention. FIGS. 2 to 4 illustrate the operational state in the cooling and the heating operations of the first embodiment illustrated in FIG. 1, and FIG. 2 illustrates the cooling or heating only operational states, FIGS. 3 and 4 illustrate the concurrent cooling and heating operation, FIG. 3 being operational state diagram for the heating dominant operation (where the heating operation capacity is larger than the cooling operation capacity) and FIG. 4 being operational state diagram for the cooling dominant operation (where the cooling operation capacity is larger than the heating operation capacity).

While this first embodiment will be described in terms of a heat source unit having three indoor units, the heat source unit having at least two indoor units will equally be applicable.

In FIG. 1, reference character A designates a heat source unit, B, C and D designate similarly constructed heat source units connected in parallel to each other as will be described in more detail later. E, which will be described in more detail later, is a junction unit including a first junction portion, a second flow rate controller, a second junction portion, a vapor-liquid separator, a heat exchanger, a third flow rate controller and a four flow rate controller.

Also, reference numeral 1 designates a compressor, 2 is a four-way valve for changing the refrigerant flow direction of the heat source unit, 3 designates a heat source unit side heat exchanger, 4 designates an accumulator connected to the compressor 1 through the four-way valve 2, and the heat source unit A comprises the compressor 1, the four-way valve 2, the heat source unit side heat exchanger 3 and the accumulator 4.

Also, reference numeral 5 designate indoor unit side heat exchangers disposed in three indoor units B, C and D, **6*b*, 6*c* and 6*d* are indoor unit side first connection pipes corresponding to the first connection pipe 6 for connecting the junction unit E to the respective indoor unit side heat exchangers 5 of the indoor units B, C and D, 7 is a second connection pipe thinner than the first connection pipe 6 for connecting the junction unit E to the heat source unit side heat exchanger 3** of the heat source unit A.

Also, reference characters **7*b*, 7*c* and 7*d* are indoor unit side second connection pipes corresponding to the second connection pipe 7 for connecting the junction unit E to the indoor unit side heat exchanger 5** of the respective indoor units B, C and D.

Reference numeral 8 designates three-way change-over valve which is a valve unit capable of selectively connecting the indoor unit side first connection pipes **6*b*, 6*c* and 6*d* to either of the first connection pipe 6 and the second connection pipe 7, and isolating the indoor unit side first connection pipes 6*b*, 6*c* and 6*d* from the first connection pipe 6 and the second connection pipe 7**.

Reference numerals 9 designate first flow rate controllers connected to the indoor unit side second connection pipes **7*b*, 7*c* and 7*d* for being controlled by the superheat amount at the outlet side of the indoor unit side heat exchanger 5 during the cooling operation (by a first valve opening degree control means 52 which will be described later, in this embodiment) and by the subcooling amount at the outlet side of the indoor unit side heat exchangers 5 during the heating operation. The first flow rate controllers 9 are connected to the indoor unit side second connection pipes 7*b*, 7*c* and 7*d***.

Reference numeral 10 designates a first junction portion comprising the three-way valves for selectively connecting the indoor unit side first connection pipes **6*b*, 6*c* and 6*d* to either the first connection pipe 6 or the second connection pipe 7**.

Reference numeral 11 designates a second junction portion comprising the indoor unit side second connection pipes **7*b*, 7*c* and 7*d* and the second connection pipe 7**.

Reference numeral 12 designates a vapor-liquid separator inserted into the second connection pipe 7, a vapor phase region thereof being connected to a first opening **8*a* of the three-way valve 8 and a liquid phase regin thereof being connected to the second junction portion 11**.

Reference numeral 13 designates a second flow rate controller (an electrical expansion valve in this embodiment) capable of closing and opening and connected between the vapor-liquid separator 12 and the second junction portion 11.

Reference numeral 14 designates a bypass pipe connecting the first connection pipe 6 to the second junction portion 11, 15 is a third flow rate controller (an electrical expansion valve in this embodiment) inserted into the bypass pipe 14, **16*a* is a second heat exchanging portion disposed downstream of the third flow rate controller 15 inserted into the bypass pipe 14 for carrying out heat-exchange with respect to the indoor unit side second connection pipes 7*b*, 7*c* and 7*d* in the second junction portion 11**.

Reference numerals **16*b*, 16*c* and 16*d* are third heat-exchanging portions disposed downstream of the third flow rate controller 15 inserted into the bypass pipe 14 for heat-exchanging in relation to the respective indoor unit side second connection pipes 7*b*, 7*c* and 7*d* in the second junction portion 11**.

Reference numeral 19 designates a first heat exchanging portion disposed downstream of the third flow rate controller 15 of the bypass pipe 14 and the second heat exchanging portion **16*a* for carrying out heat-exchanging in relation to the pipe connecting the vapor-liquid separator 12 and the second flow rate controller 13, and reference numeral 17 designates a fourth flow rate controller (an electrical expansion valve in this embodiment) capable of opening and closing the connection between the second junction portion 11 and the first connection pipe 6**.

On the other hand, reference numeral 32 is a third check valve disposed between the heat source unit side heat exchanger 3 and the second connection pipe 7 for allowing the refrigerant to flow only from the heat source side heat exchanger 3 to the second connection pipe 7.

Reference numeral 33 is a fourth check valve disposed between the four-way valve 2 of the heat source unit A and the first connection pipe 6 for allowing the refrigerant to flow only from the first connection pipe 6 to the four-way valve 2.

Reference numeral 34 designates a fifth check valve disposed between the four-way valve 2 of the heat source unit A and the second connection pipe 7 for allowing the refrigerant to flow only from the first connection pipe 6 to the four-way valve 2.

Reference numeral 35 designates a sixth check valve disposed between the heat source unit side heat exchanger 3 and the first connection pipe 6 for allowing the refrigerant to flow only from the heat source unit side heat exchanger 3 to the first connection pipe 6.

The above-described third, fourth, fifth and sixth check valves 32, 33, 34 and 35, respectively, constitute a flow path change-over unit 40.

Reference numeral 25 designates a first pressure detecting means disposed between the first junction portion 10 and the second flow rate controller 13, and 26 is a second pressure detecting means disposed between the second flow rate controller 13 and the fourth flow rate controller 17.

Reference numeral 50 designates a suction air temperature detecting means for detecting suction air of the indoor unit side heat exchanger 5, 51 designates a opening degree setting means for setting a minimum opening degree in accordance with a difference between the suction air temperature detected by the suction air temperature detecting means 50 and the target temperature set beforehand for the indoor unit, and 52 designates a first valve opening degree control means for controlling opening degree corresponding to the minimum opening degree, which constitutes a control device for the first flow rate controller 9 by the suction air temperature detecting means 50, the opening degree setting means 51 and the first valve opening degree control means 52.

The operation of the above first embodiment will now be described.

First, the cooling only operation will be described in conjunction with FIG. 2. As illustrated by solid arrows in FIG. 2, the high temperature, high pressure refrigerant gas supplied from the compressor 1 flows through the four-way valve 2, heat-exchanged in relation to outdoor air in the heat source unit side heat exchanger 3 to be condensed into liquid, and flows through the third check valve 32, the second connection pipe 7, the vapor-liquid separator 12, the second flow rate controller 13, the second junction portion 11 and indoor unit side second connection pipes **7*b*, 7*c* and 7*d*** to be supplied into the respective indoor units B, C and D.

The refrigerant flowed into the respective indoor units B, C and D is pressure-reduced by the respective first flow rate controllers 9 and heat-exchanged in the indoor unit side heat exchangers 5 in relation to the indoor air to evaporate into vapor to cool the room.

The refrigerant in the vapor state follows the circulating cycle from the indoor unit side first connection pipes **6*b*, 6*c* and 6*d* to the compressor 1 through the three-way valve 8, the first junction portion 10, the first connection pipe 6, the fourth check valve 33, the heat source side four-way valve 2 and the accumulator 4** to achieve the cooling operation.

At this time, the first opening **8*a* of the three-way valve 8 is closed, and the second opening 8*b* and the third opening 8*c* are opened, and since the first connection pipe 6 is at a low pressure and the second connection pipe 7 is at a high pressure, the refrigerant flows through the third check valve 32 and the fourth check valve 33**.

In this cycle, a portion of the refrigerant passed through the second flow rate controller 13 enters into the bypass pipe 14 and is pressure-reduced to a low pressure at the third flow rate controller 15. The refrigerant then is heat-exchanged in the third heat exchanging portions **16*b*, 16*c* and 16*d* in relation to the indoor unit side second connection pipes 7*b*, 7*c* and 7*d* of the second junction portion 11, and is heat-exchanged in the second heat exchanging portion 16*a* in relation to the meeting portions of the indoor unit side second connection pipes 7*b*, 7*c* and 7*d* of the second junction portion 11, and is further heat-exchanged in the first heat exchanging portion 19 in relation to the refrigerant flowing into the second flow rate controller 13, the evaporated refrigerant being suctioned into the compressor 1 through the first connection pipe 6, the fourth check valve 33, the four-way valve 2 of the heat source unit and the accumulator 4**.

On the other hand, the refrigerant at the second function portion 11 which is heat-exchanged and cooled at the first, the second and the third heat exchanging portions 19, **16*a*, 16*b*, 16*c* and 16*d*** and sufficiently subcooled flows into the indoor units B, C and D to be operated for cooling.

Next, the heating-only operation will be described in conjunction with FIG. 2. As illustrated by dashed-line arrows in FIG. 2, the high temperature, high pressure refrigerant gas supplied from the compressor 1 flows through the four-way valve 2, the fifth check valve 34, the first connection pipe 6, the vapor-liquid separator 12, the first junction portion 10, the three-way valve 8 and the indoor unit side first connection pipes **6*b*, 6*c* and 6*d*** to flow into the indoor units B, C and D to be heat-exchanged in relation to indoor air into liquid to heat the room.

The refrigerant in the liquid state flows through the first flow rate controller 9 which is controlled in the substantially fully-opened state by the subcooling amount at the outlet of the respective indoor unit side heat exchanger 5, flows through the indoor unit side second connection pipes **7*b*, 7*c* and 7*d* into the second junction portion 11 to joint together to further flow through the fourth flow rate controller 17**.

At this time, the refrigerant is pressure-reduced to a low-pressure vapor-liquid two phase state at either of the first flow rate controllers 9 or the third and the fourth flow rate controllers 15 and 17.

The refrigerant pressure-reduced to a low pressure follows the circulating cycle from the first connection pipe 6 to the compressor 1 through the sixth check valve 6 of the heat source unit A, the heat source unit side heat exchanger 3, where it is heat-exchanged in relation to the outdoor air to evaporate into a gaseous state and further flows through the four-way valve 2 and the accumulator 4.

At this time, the second opening 8*b* of the three-way valve 8 is closed, and the first opening 8*b* and the third opening 8*c* are opened, and since the first connection pipe 6 is at a low pressure and the second connection pipe 7 is at a high pressure, they are communicated to the fifth check valve 34 and the sixth check valve 35 because it is in communication with the suction side of the compressor 1 and the outlet side of the compressor 1, respectively.

The heating-dominant operation in the concurrent cooling and heating operation will now be described in conjunction with FIG. 3. In this case, the description will be made as to where the two indoor units B and C are to be operated for heating and the indoor unit D is to be operated for cooling. As shown by the dotted arrows in the figure, the high temperature, high pressure refrigerant gas supplied from the compressor 1 is supplied to the junction unit E through the four-way valve 2, the fifth check valve 34 and the second connection pipe 7, and then introduced into the indoor units B and C to be operated for heating through the vapor-liquid separator 12, the first junction portion 10, the three-way valve 8 and the indoor unit side first connection pipes 6*b* and 6*c*, and the refrigerant is heat-exchanged in the indoor unit side heat exchanger 5 in relation to the indoor air to be condensed into liquid to heat the room.

The condensed liquid refrigerant flows through the first flow rate controller 9, which is controlled to the substantially fully opened state by the subcooling amount at the outlet of the indoor unit side heat exchangers 5 of the indoor units B and C, to be slightly pressure-reduced and introduced into the second junction portion 11.

One portion of this refrigerant flows through the indoor unit side second connection pipe 7*d* to enter into the indoor unit D to be operated for cooling, and flows through the first flow rate controller 9 controlled by the first valve opening degree control means 52 which will be described later to be pressure-reduced, and then flows into the indoor unit side heat exchanger 5 to be heat-exchanged to evaporate into a gaseous state to cool the room, and then flows into the first connection pipe 6 through the first connection pipe 6*d* and the three-way valve 8.

On the other hand, the other refrigerant flows through the fourth flow rate controller 17, which is controlled so that a pressure difference between the detected pressures of the first pressure detecting means 25 and the second pressure detecting means 26 is within a predetermined range, and combined with the refrigerant flowed through the indoor unit D to be operated for cooling, to flow into the heat source side heat exchanger 3 through the thick first connection pipe 6 and the sixth check valve 35 of the heat source unit A, where it is heat-exchanged in relation to the outdoor air to evaporate into the gaseous state.

This refrigerant follows a circulating cycle extending to the compressor 1 through the four-way valve 2 of the heat source unit and the accumulator 4, whereby the heating-dominant operation is carried out.

At this time, the vapor pressure of the indoor unit side heat exchanger 5 of the indoor unit D to be operated for cooling and the pressure difference of the heat source unit side heat exchanger 3 is reduced because the thick first connection pipe 6 is substituted.

Also, at this time, the second opening 8*b* of the three-way valve 8 connected to the indoor units B and C is closed and the first opening 8*a* and the third opening 8*c* are opened, and the first opening 8*a* of the indoor unit D is closed and the second opening 8*b* and the third opening 8*c* are opened.

Also, at this time, since first connection pipe 6 is at a low pressure and the second connection pipe 7 is at a high pressure, the refrigerant flows into the fifth check valve 34 and the sixth check valve 35.

In this cycle, one portion of the liquid refrigerant flows from the meeting portion of the indoor unit side second connection pipes 7*b*, 7*c* and 7*d* of the second junction portion 11 to the bypass pipe 14, pressure-reduced at the third flow rate controller 15, and heat-exchanged at the third heat exchanging portions 16*b*, 16*c* and 16*d* in relation to the indoor unit side second connection pipes 7*b*, 7*c* and 7*d* of the second junction portion 11 and at the second heat exchanging portion 16*a* in relation to the meeting portions of the indoor unit side second connection pipes 7*b*, 7*c* and 7*d* of the second junction portion 11, and further heat-exchanged in the first heat exchanging portion 19 in relation to the refrigerant flowing into the second flow rate controller 13, the evaporated refrigerant being supplied to the first connection pipe 6 and the sixth check valve 35 from where it is suctioned by the compressor 1 through the heat source unit four-way valve 2 and the accumulator 4.

On the other hand, the refrigerant at the second junction portion 11, which is heat-exchanged in the second and the third heat exchanging portions 16*a*, 16*b*, 16*c* and 16*d* to be sufficiently subcooled, is supplied to the indoor unit D to be operated for cooling.

Next, the cooling-dominant operation in the concurrent cooling and heating operation will now be described in conjunction with FIG. 4 in terms of the operation where two indoor units B and C are to be operated for cooling and the indoor unit D is to be operated for heating. As illustrated by solid-line arrows in FIG. 4, the refrigerant gas supplied from the compressor 1 flows through the four-way valve 2 to the heat exchanger 3, where it is heat-exchanged in relation to outdoor air to become two phase high-pressure and high-temperature state.

After this, the refrigerant in the high-temperature, high-pressure two phase state is supplied to the vapor-liquid separator 12 of the junction unit E through the third check valve 32 and the second connection pipe 7.

The refrigerant is then separated into the gaseous refrigerant and the liquid refrigerant, and the separated gaseous refrigerant flows through the first junction portion 10, the three-way valve 8 and the indoor unit side first connection pipe 6*d* into the indoor unit D to be operated for heating, where it is heat-exchanged in the indoor unit side heat exchanger 5 in relation to the indoor air to be condensed into liquid to heat the room.

The refrigerant further flows through the first flow rate controller 9 controlled by the subcooling amount at the outlet of the indoor unit side heat exchanger 5 to be a substantially fully opened state to be slightly pressure-reduced to become an intermediate pressure (intermediate) between the high and the low pressure and flows into the second junction portion 11.

On the other hand, the remaining refrigerant flows through the second flow rate controller 13, which is controlled so that a pressure difference between the high pressure and the intermediate pressure is maintained constant on the basis of the detected pressures of the first pressure detecting means 25 and the second pressure detecting means 26, flows into the second junction portion 11 to be combined with the refrigerant flowed through the indoor unit D to be operated for heating, and flows into the indoor units B and C through the indoor unit side second connection pipes 7b and 7c. The refrigerant flowed into the respective indoor units B and C is pressure-reduced to a low pressure by the first flow rate controller 9 controlled by a first valve opening degree controlling means 52 which will be described later to be heat-exchanged in relation to the indoor air to evaporate into the gaseous state to cool the room.

This refrigerant in the gaseous state follows a circulating cycle extending to the compressor 1 through the indoor unit side first connection pipes 6b and 6c, the three-way valve 8, the first connection pipe 10, the first connection pipe 6, the fourth check valve 33, the four-way valve 2 of the heat source unit and the accumulator 4, whereby the cooling-dominant operation is carried out.

Also, at this time, the first opening 8a of the three-way valve 8 connected to the indoor units B and C is closed and the second opening 8b and the third opening 8c are opened, and the second opening 8b of the indoor unit D is closed and the first opening 8b and the third opening 8c are opened.

Also, at this time, since the first connection pipe 6 is at a low pressure and the second connection pipe 7 is at a high pressure, the refrigerant flows into the third check valve 32 and the fourth check valve 33.

In this cycle, one portion of the liquid refrigerant flows from the meeting portion of the indoor unit side second connection pipes 7b, 7c and 7d of the second junction portion 11 to the bypass pipe 14, pressure-reduced to a low pressure at the third flow rate controller 15, and heat-exchanged at the third heat exchanging portions 16b, 16c and 16d in relation to the indoor unit side second connection pipes 7b, 7c and 7d of the second junction portion 11 and at the second heat exchanging portion 16a in relation to the meeting portions of the indoor unit side second connection pipes 7b, 7c and 7d of the second junction portion 11, and further heat-exchanged in the first heat exchanging portion 19 in relation to the refrigerant flowing into the second flow rate controller 13, the evaporated refrigerant being supplied to the first connection pipe 6 and the fourth check valve 33 from where it is suctioned by the compressor 1 through the heat source unit four-way valve 2 and the accumulator 4.

On the other hand, the refrigerant at the second junction portion 11, which is heat-exchanged in the first, the second and the third heat exchanging portions 19, 16a, 16b, 16c and 16d to be sufficiently subcooled, is supplied to the indoor unit D to be operated for cooling.

The description will now be made as to the control of the first flow rate controller 9 of the indoor unit to be operated for cooling.

Figure 5:
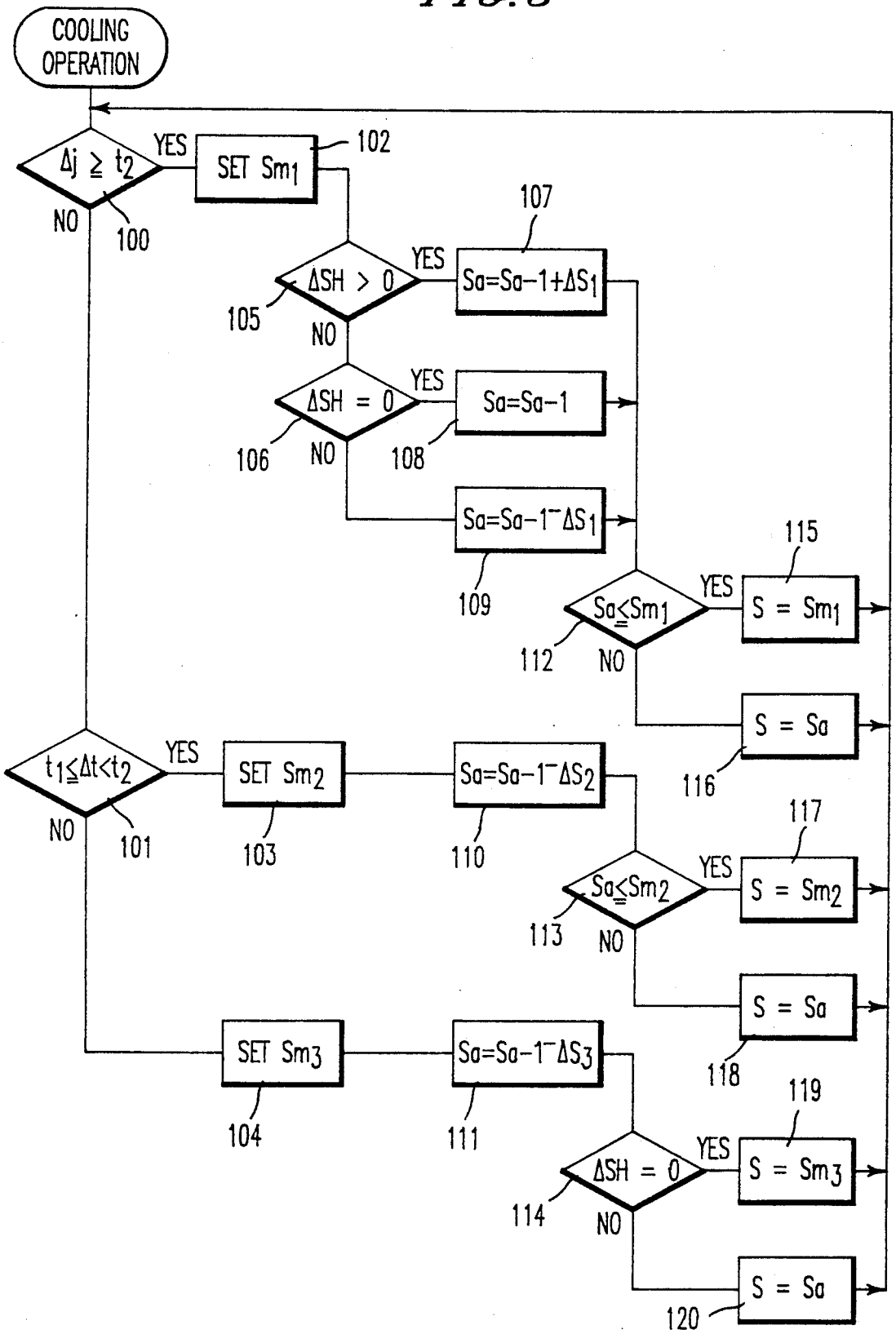
FIG. 5 is a flow chart illustrating the control of the valve opening degree of the first flow rate controller in the air-conditioning system of the present invention.

FIG. 5 is a flow chart illustrating the control of the valve opening degree setting means 51 and the first valve opening degree control means 52.

Firstly, a control process of the first flow rate controller 9 by the opening degree setting means 51 and the first valve opening degree controlling means 52 will now be described.

In the first embodiment, following three minimum opening degrees are set in accordance with a temperature difference $\Delta t \geqq t_a - t_0$ between a target temperature $t_0$ previously set in the indoor units and a detected temperature $t_a$ of the suction air temperature detecting means 50.

The first minimum valve opening degree $Sm_1$ is provided where the temperature difference $\Delta t$ is $\Delta t \geqq t_2$ and the rating cooling capacity is required to the indoor units. Therefore, in this case, the opening degree control in response to an outlet superheat SH at the outlet of the indoor unit side heat exchanger 5. That is, when the difference $\Delta SH = SH - SHm$, which is the difference between a target superheat SHm previously set for the indoor unit and the outlet superheat SH, can be expressed as $\Delta SH < 0$, it is determined that the refrigerant is short and the opening degree is increased. Contrary, when $\Delta SH > 0$, it is determined that the refrigerant is superfluous and the opening degree is decreased. When $\Delta SH = 0$, it is determined that the refrigerant amount is proper and the opening degree is maintained.

The second minimum opening degree $Sm_2$ is for the case where the temperature difference $\Delta t$ is expressed as $t_1 \leqq \Delta t < t_2$ and is set to be smaller than the first minimum valve opening degree $Sm_1$. This is because the cooling capacity required in the indoor unit is less than the case where $\Delta t = t_2$ and only the refrigerant of the corresponding amount is needed to be supplied. That is, in this case, if only the first minimum valve opening degree $Sm_1$ can be set and the opening degree control is carried out by the superheating amount, the amount of the refrigerant is to large, so that the indoor units repeat running and stopping because of unbalanced required cooling capacity, disturbing the stability of the circulating cycle and degrading the comfort due to intermittent blow of cold wind. As above described, by providing the second minimum valve opening degree $Sm_2$ and decreasing the opening degree at a predetermined rate, an opening degree suitable for flowing the amount of the refrigerant which matches the required capacity and, also, by gradually controlling the opening degree, the stability of the circulating cycle is not disturbed.

The third minimum valve opening degree $Sm_3$ is for where the temperature difference $\Delta t$ is expressed as $\Delta t < t_1$, which is smaller than the second minimum valve opening degree. This is because the cooling capacity required to the indoor unit may be made further smaller than that in the case of $t_1 \leqq \Delta t < t_2$, and it is only required to flow an amount of the refrigerant in accordance with the capacity. The concept of opening degree setting and the opening degree control is similar to the case where $t_1 \leqq \Delta t \leqq t_2$, so that the description thereof is omitted.

The control state of a first valve opening degree control means 52 of the first flow rate controller 9 in accordance with the first embodiment will be described in conjunction with a flow chart shown in FIG. 5.

The indoor unit to be operated for cooling determines in a step 100 the temperature difference $\Delta t = t_a - t_0$ between the predetermined target temperature $t_0$ and the suction air temperature $t_a$ detected by the suction air temperature detecting means 50 to proceed to a step 102 when $\Delta t \geqq t_2$ and to a step 101 when $\Delta t < t_2$. In the step 102, the first minimum valve opening degree $Sm_1$ is set and determines in a step 105 a difference $\Delta SH = SH - SHm$ between the outlet superheat SH of the indoor side heat exchanger 5 and the predetermined target superheat SHm to proceed, when $\Delta SH > 0$, to a step 107 where a provisional opening degree $S_a$ which is a sum of the previous provisional opening degree $S_{a-1}$ and the first opening degree correction $\Delta S_1$ and further to a step 112. When $\Delta SH \geqq 0$ in the step 105, a step 106 is followed and when $\Delta SH = 0$, a step 108 is followed in which the provisional opening degree $S_a$ is taken as the previous provisional opening degree $S_{a-1}$ to further proceed to a step 112. Also, in the step 106, when $\Delta SH < 0$, the provisional opening degree $S_a$ which is a subtraction of the first opening degree correction $\Delta S_1$ from the previous provisional opening degree $S_{a-1}$ is calculated in a step 109 to proceed to the step 112. In the step 112, the provisional opening degree $S_a$ is compared with the first minimum valve opening degree $Sm_1$ and when it is equal to or less than $Sm_1$, a step 115 is selected to output $Sm_1$ as the opening degree S, and when it is larger than $Sm_1$, a step 116 is selected to output $S_a$ as the opening degree S. When proceeded to the step 101, a step 103 is selected when $\Delta t$ is $T_1 \leqq \Delta t < t_2$ to provide the second minimum valve opening degree $Sm_2$, from where a step 110 is pursued to calculate the provisional opening degree $S_a$ which is a subtraction of the second opening degree correction $\Delta S_2$ from the previous provisional opening degree $S_{a-1}$ to further proceed to a step 113. In the step 113, the provisional opening degree Sa is compared with the second minimum valve opening degree $Sm_2$ and the process proceeds to a step 117 when it is equal to or less than $Sm_2$ to provide an output of $Sm_2$ as the opening degree S and proceeds to a step 118 when it is larger than $Sm_2$ to provide an output of $S_a$ as the opening degree S.

When the process proceeds to the step 104 without satisfying the condition of the step 101, a third minimum valve opening degree $Sm_3$ is set, and the process proceeds to a step 111 where the provisional opening degree $S_a$ is calculated by a subtraction of the third opening degree correction $\Delta S_3$ from the previous provisional opening degree $S_{a-1}$ and further proceeds to a step 114. In the step 114, the provisional opening degree $S_a$ is compared with the third minimum valve opening degree $Sm_3$ and proceeds to a step 119 when it is equal to or less than $Sm_3$ to provide an output of $Sm_3$ as an output and proceeds to a step 120 when it is larger than $Sm_3$ to provide an output of the opening degree S.

Thus, according to the first embodiment, suction air temperature detecting means 50 for detecting a suction air temperature of the indoor units, opening degree setting means 51 for setting a minimum valve opening degree of the first flow rate controller 9 in accordance with a difference between a detected temperature and a predetermined target temperature, and first valve opening degree controlling means 52 for controlling the valve opening degree in accordance with the temperature difference, so that the amount of the refrigeration supplied to the indoor side heat exchanger 5 can be properly regulated, enabling a continuous stable operation of the indoor units and surpression of disturbance to other indoor units, the junction unit and the heat source unit, whereby the cooling and heating operations can be selectively carried out with a plurality of indoor units and cooling by some of the indoor units and heating by the remaining indoor units can concurrently and stably be carried out.

Figure 6:
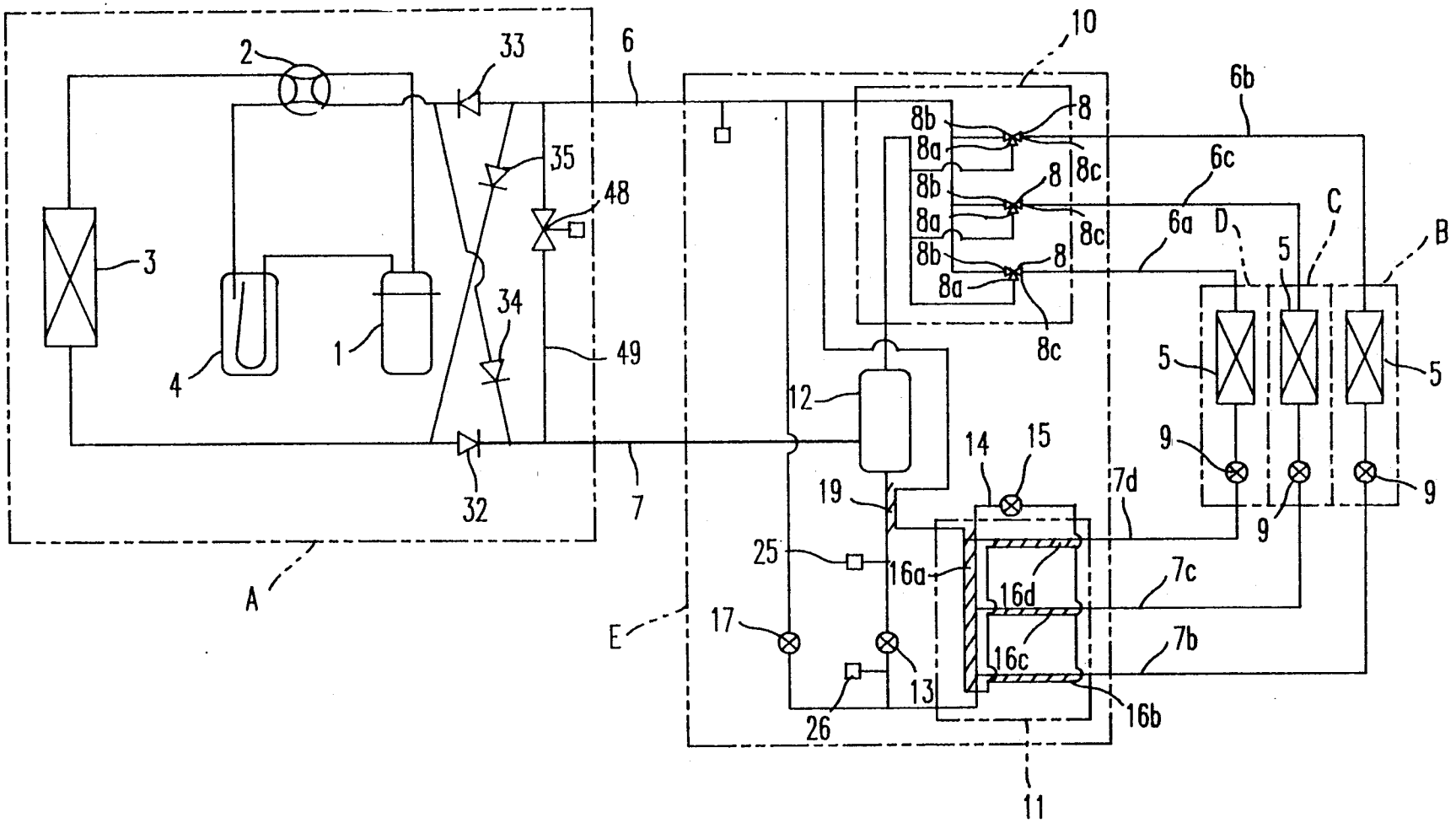
FIG. 6 is a schematic diagram generally illustrating the refrigerant lines of the air-conditioning system of the present invention which includes a bypass circuit for a defrosting operation.
Figure 7:
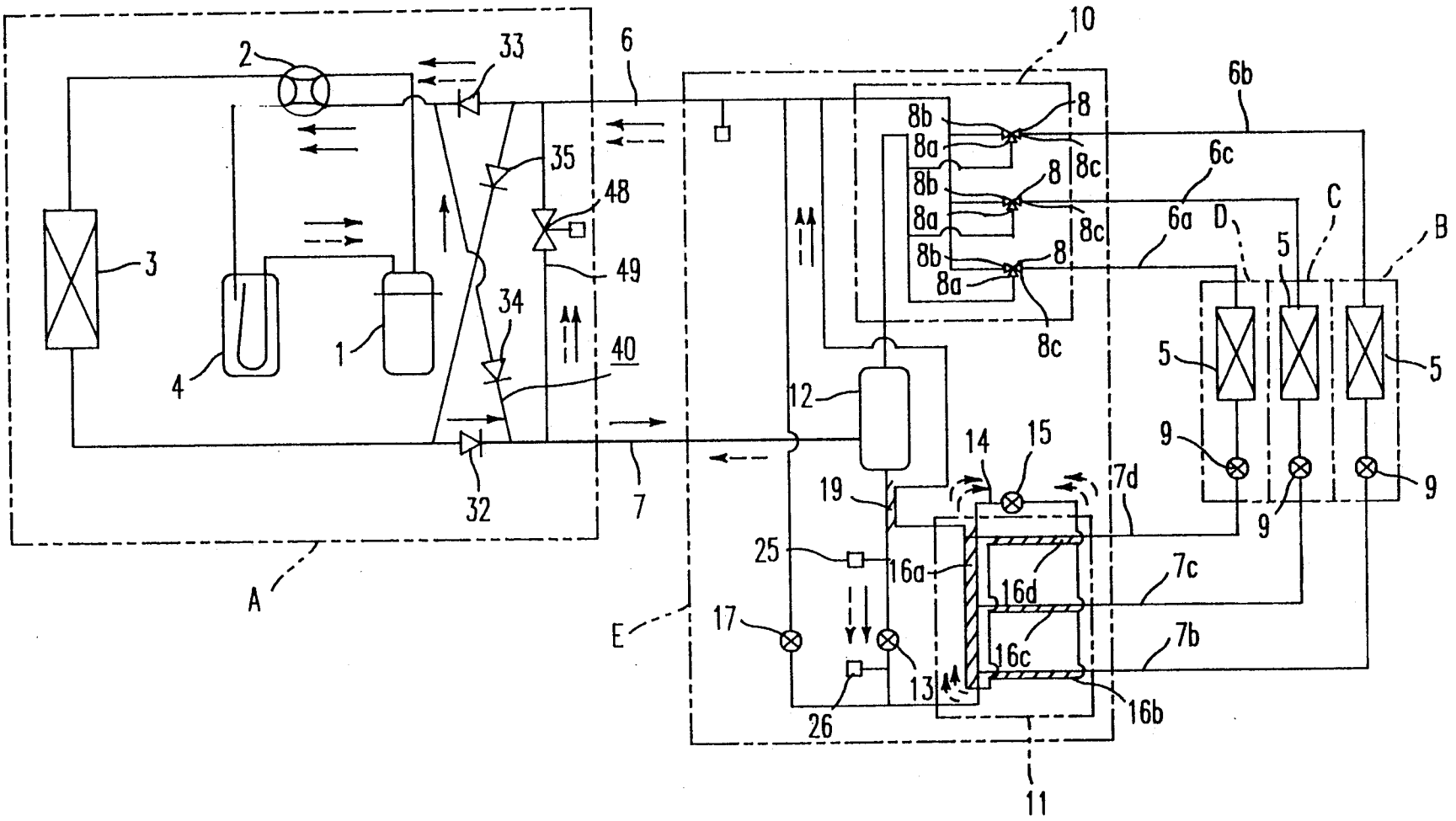
FIG. 7 is a refrigerant circuit diagram for explaining the defrosting operation state in the air-conditioning system of the present invention.

FIG. 6 is a general schematic diagram illustrating the refrigerant lines of the air-conditioning system of the invention with the provision for a defrosting operation, and FIG. 7 is an operational state diagram illustrating the defrost operation.

In the figures, reference numeral 49 designates a first bypass circuit connected between the first connection pipe 6 and the second connection pipe 7, and 48 designates a sixth solenoid valve inserted into the pipe of the first bypass circuit 49 for closing and opening the first bypass circuit 49.

The cooling-only and the heating-only operations as well as the heating-dominant and the cooling-dominant operations in this embodiment are, with the first bypass circuit 49 brought into a closed state by the sixth solenoid valve 48, similar to those of the previously described embodiment.

The defrost operation will now be described on the basis of FIG. 7.

When the defrost operation is initiated, the second flow rate controller 13, the third flow rate controller 15 and the sixth solenoid valve 48, which are inserted into the first bypass circuit 49 connected between the second connection pipe 7 and the first connection pipe 6 or connected between the four-way valve 2 and the suction side of the compressor 1, are opened. As a result, a major portion of the high temperature, high pressure vapor refrigerant filled in the second connection pipe 7 immediately after the initiation of the defrost operation, as illustrated by the dashed-line arrows in FIG. 7 flows to the low-pressure side through the first bypass circuit 49, the fourth check valve 33 and the four-way valve 2 to enter into the accumulator 4. The slight remaining refrigerant of a pipe 7 is pressure-reduced to a lower pressure and passes successively through the vapor-liquid separator 12, the second flow rate controller 13 and the third flow rate controller 15 to flow into the accumulator 4 through the first connection pipe 6, the fourth check valve 33 and the four-way valve 2.

After the vapor refrigerant in the second connection pipe 7 has been drawn to the low-pressure side, the high temperature, high pressure refrigerant vapor 4 supplied from the compressor 1 as illustrated by the solid arrows flows through the four-way valve 2 and is heat-exchanged with frost at the heat source unit side heat exchanger 3 and condensed into liquid. The refrigerant then flows through the third check valve 32 and the major portion thereof flows through the first bypass circuit 49 to be pressure-reduced to a low pressure, with the other small portion of the refrigerant flowing through the second connection pipe 7 and the vapor-liquid separator 12 in the named order, pressure-reduced at the second flow rate controller 13 or the third flow rate controller 15 to the low pressure, and flowing into the heat source unit through the first connection pipe 6. The refrigerant which passed through the first bypass circuit 49 and the refrigerant which passed through the junction unit E are combined at the inlet portion of the fourth check valve 33 and flow into the compressor 1 through the fourth check valve 33, the four-way valve 2 and the accumulator 4.

Since the circulation cycle is thus formed, the front formed on the heat source unit side heat exchanger 3 can be quickly and reliably melted by picking up heat of the refrigerant filled in the second connection pipe 7 before the initiation of the defrosting operation, the heat in the second connection pipe 7 itself, and the heat in the junction unit E. Also, most of the high-temperature, high-pressure vapor refrigerant which is filled in the second connection pipe 7 immediately after the initiation of the defrost operation flows into the low-pressure side through the first bypass circuit 49, and since only small amount of the refrigerant flows through the second and the third flow rate controllers 13 and 15, the noise which is generated when the high-temperature, high-pressure vapor refrigerant flows through the second and the third flow rate controllers 13 and 15 is reduced or eliminated. However, the heat in the junction unit E can be sufficiently recovered. Further, since most of the refrigerant condensed into liquid by heat-exchanging in relation to the frost in the heat source unit side heat exchanger 3 is pressure-reduced to a lower pressure through the first bypass circuit 49, the amount of the refrigerant which is pressure-reduced to the low pressure in the second flow rate controller 13 or the third flow rate controller 15 is relatively small, and since the refrigerant which flows into the second and the third flow rate controller 13 and 15 is liquid because it is sufficiently cooled beforehand in the first and the second heat exchanging portions 19 and 16*a*. As a result the noise generated by the refrigerant flowing through the second and the third flow rate controllers 13 and 15 is further reduced.

During the defrosting operation, most of the refrigerant condensed and liquidified in the heat source unit side heat exchanger 3 flows through the first bypass circuit 49 but the remaining refrigerant flows through the bypass circuit 14 to which the third flow rate controller 15 is connected because it is in the open state to recover heat in the junction unit E, thereby improving the defrosting capacity.

According to the present invention the first bypass circuit 49 is connected between the first connection pipe 6 and the second connection pipe 7 and opens during the defrosting operation, so that the heat of the refrigerant filled in the second connection pipe 7 immediately before the defrosting operation and the heat of the second connection pipe 7 itself can be recovered, thereby quickly and reliably melting the frost formed on the heat source unit side heat exchanger 3.

Also, immediately after the initiation of the defrosting operation, the high-temperature and high-pressure vapor refrigerant filled in the second connection pipe 7 flows through the first bypass circuit 49 to the low-pressure side, so that there is no noise generated by the high-temperature and high-pressure vapor refrigerant in the junction unit E. Further, since the refrigerant condensed and liquidified by the heat-exchange in relation to the frost in the heat source unit side heat exchanger 3 is pressure-reduced to a low pressure through the first bypass circuit 49, no noise of the refrigerant is generated in the junction unit E, realizing the reduction of noise of the junction unit E during the defrosting operation.

Further, since a bypass pipe 14 connected at one end to the second junction portion 11 and at the other end to the first connection pipe 6 through the third flow rate controller 15 is provided for constituting the circuit (including the third flow rate controller 15 during the defrosting ope ation), the heat in the junction unit E can be recovered and the defrost capacity is improved.

Figure 8:
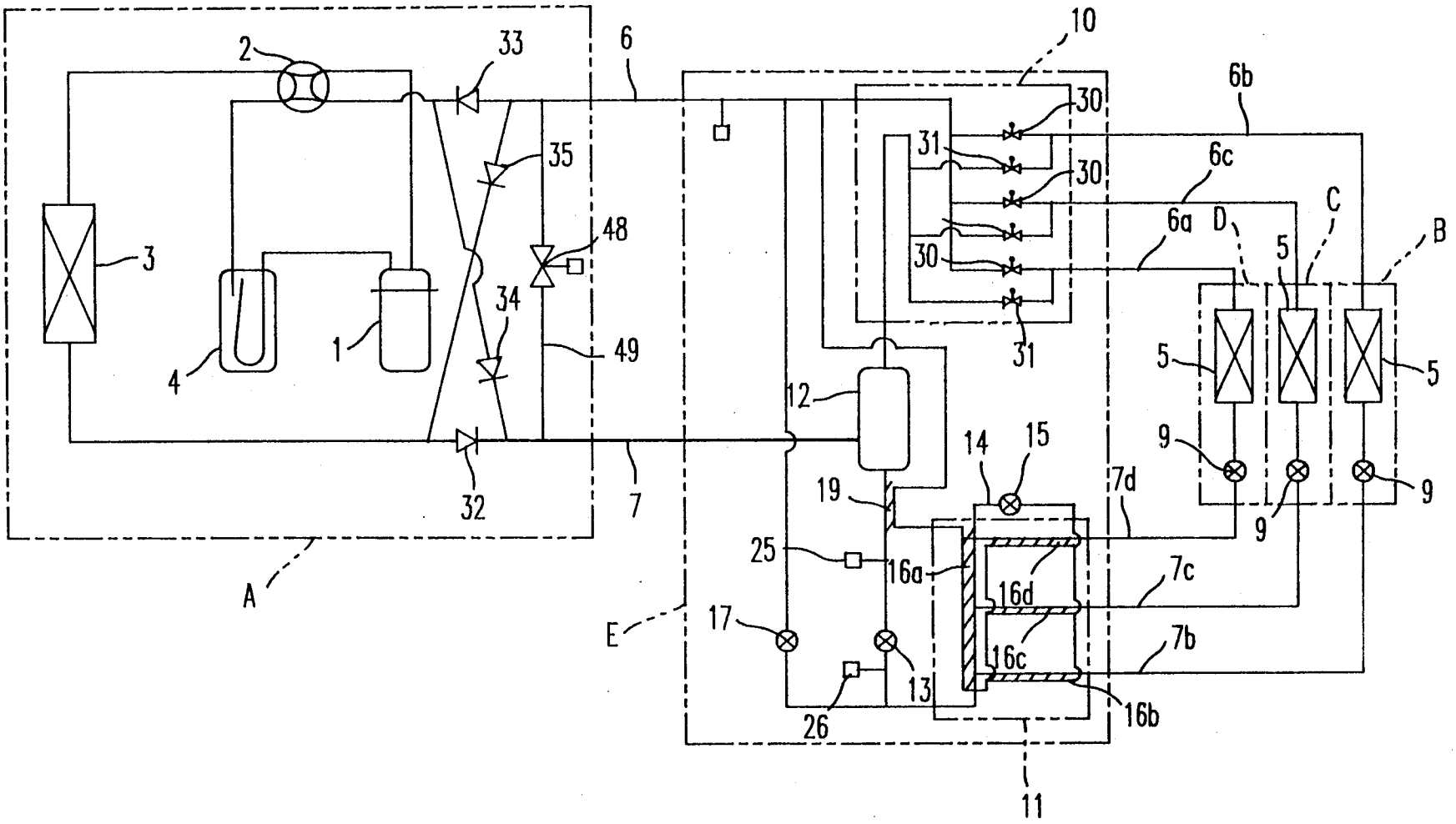
FIG. 8 is a schematic diagram generally illustrating the refrigerant lines of the air-conditioning system of an alternate embodiment of the present invention.
Figure 9:
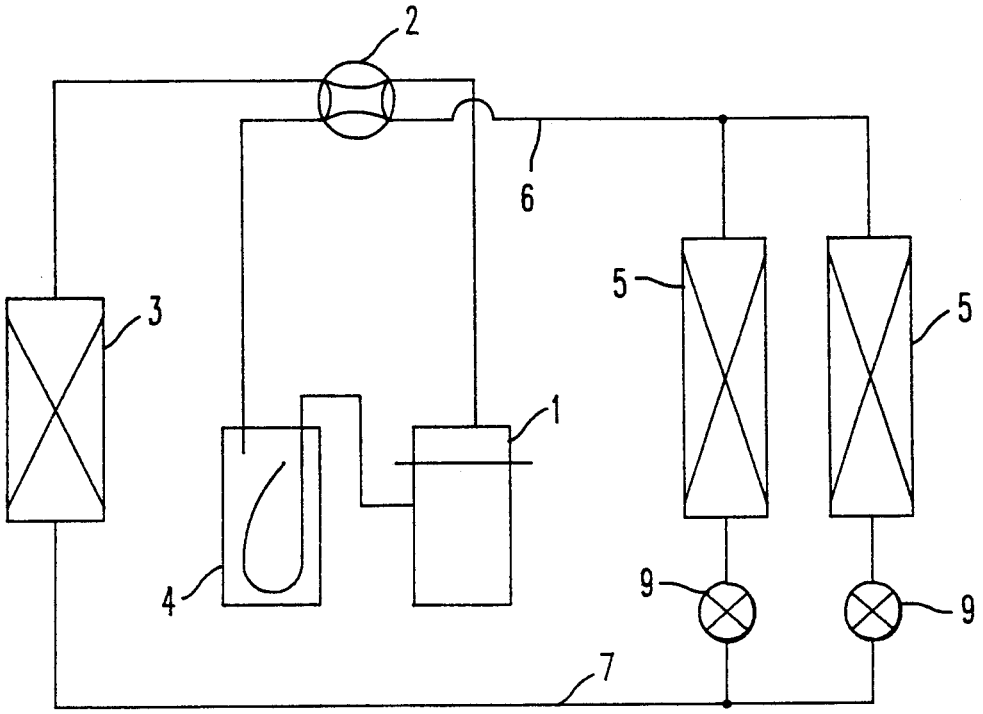
FIG. 9 PRIOR ART
FIG. 9 is a schematic diagram illustrating one example of a conventional air-conditioning system.
Figure 10:
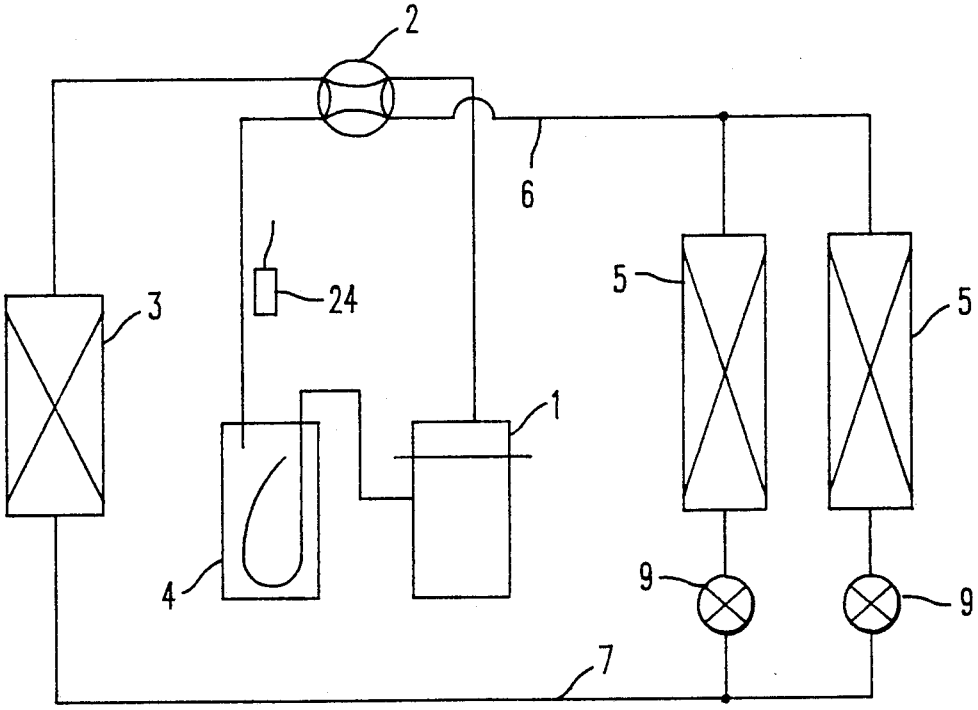
FIG. 10 PRIOR ART
FIG. 10 is a schematic diagram illustrating another example of a conventional air-conditioning system.
Figure 11:
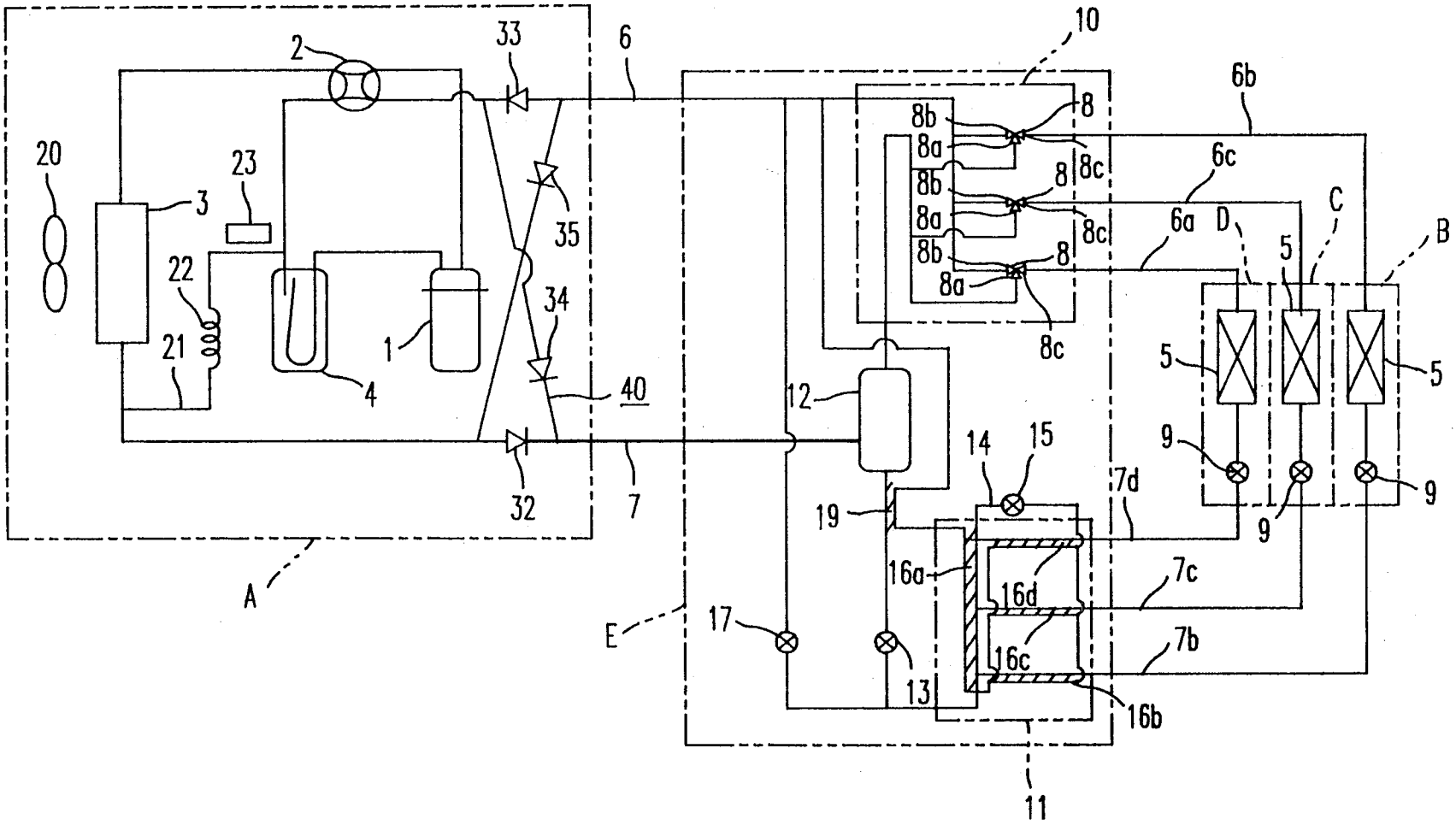
FIG. 11 PRIOR ART
FIG. 11 is a schematic diagram illustrating a further example of a conventional air-conditioning system.

While the three-way valve 8 is provided for selectively connecting the indoor unit side first connection pipes 6*b*, 6*c* and 6*d* to the first connection pipe 6 or to the second connection pipe 7 in the embodiment of FIGS. 6 and 7, a change-over valve such as two solenoid valves 30 and 31 may also be provided in selective connection as illustrated in FIG. 8 and similar advantageous results can be obtained.

According to the present application, the provision is made of the first bypass circuit which is connected between the first connection pipe and the second connection pipe and which opens when during the defrosting operation, so that the heat of the refrigerant filled in the second connection pipe immediately before the defrosting operation and the heat of the second connection pipe itself can be recovered, thereby to quickly and reliably melt the frost formed on the heat source unit side heat exchanger. Also, immediately after the initiation of the defrosting operation, the high-temperature and high-pressure vapor refrigerant filled in the second connection pipe flows through the first bypass circuit to the low-pressure side, so that there is no noise generated by the high-temperature and high-pressure vapor refrigerant in the junction unit. Also, since the refrigerant condensed and liquidified by the heat-exchange in relation to the frost in the heat source unit side heat exchanger is pressure-reduced to the low pressure through the first bypass circuit, no noise of the refrigerant is generated in the junction unit, realizing the reduction of noise of the junction unit during the defrosting operation.

Obviously numerous modifications and variations are possible in light of the above teachings. It is therefore understood that within the scope of the appended claims, the invention may be practiced otherwise than as specifically described herein.

What is claimed is:

1. An air-conditioning system wherein a single heat source unit having a compressor, a four-way valve, a heat source unit side heat exchanger and an accumulator is connected to a plurality of indoor units having an indoor side heat exchanger and a first flow rate controller through first and second connection pipes;

a first branch joint including a valve device for selectively connecting one of said plurality of indoor units to said first connection pipe or said second connection pipe and a second branch joint connected to another of said indoor side heat exchangers of said plurality of indoor units through said first flow rate controller and connected to said second connection pipe through a second flow rate controller are connected to each other through said second flow rate controller and a gas-liquid separating unit;

said second branch joint and said first connection pipe are connected through a fourth flow rate controller;

said second branch joint and said first connection pipe are connected through a bypass pipe having a third flow rate controller therein; and said air conditioning system comprises;

a first heat exchanger portion for carrying out the heat-exchanging between said bypass pipe between said third flow rate controller and said first connection pipe and pipings connecting said second connection pipe and said second flow rate controller;

a flow path change over unit for allowing, when said heat source unit side heat exchanger is operated as a condenser, a flow of a refrigerant from a refrigerant outlet side of said condenser only to said second connection pipe and a flow of the refrigerant from said first connection pipe only to said fourth-way valve side, and allowing, when said heat source unit side heat exchanger is operated as an evaporator, a flow of the refrigerant from said first connection pipe only to a refrigerant inlet side of said evaporator and a flow of the refrigerant from said four-way valve only to said second connection pipe; and a junction unit disposed between said heat source unit and said plurality of indoor units, said intermediate unit comprising said first branch joint, said second branch joint, said gas-liquid separator, said second flow rate controller, said third flow rate controller, said fourth flow rate controller, said first heat exchanging portion and said bypass pipes;

characterized by the provision of:

a first bypass circuit which is connected between said first connection pipe and said second connection pipe and which is opened during the defrosting operation, wherein said second connection pipe is maintained at a high pressure and said first connection pipe is maintained at a relative low pressure with respect to said second connection pipe and upon opening of said first bypass circuit for a defrosting operation refrigerant from the high pressure second connection pipe flows through said first bypass circuit and flows directly into the low pressure first connection pipe.

2. An air-conditioning system wherein a single heat source unit having a compressor, a four-way valve, a heat source unit side heat exchanger and an accumulator is connected to a plurality of indoor units having an indoor side heat exchanger and a first flow rate controller through first and second connection pipes;

a first branch joint including a valve device for selectively connecting one of said plurality of indoor units to said first connection pipe or said second connection pipe and a second branch joint connected to another of said indoor side heat exchangers of said plurality of indoor units through said first flow rate controller and connected to said second connection pipe through a second flow rate controller are connected to each other through said second flow rate controller and a gas-liquid separating unit;

said second branch joint and said first connection pipe are connected through a fourth flow rate controller;

said second branch joint and said first connection pipe are connected through a bypass pipe having a third flow rate controller therein; and said air conditioning system comprising:

a first heat exchanger portion for carrying out the heat-exchanging between said bypass pipe between said third flow rate controller and said first connection pipe and pipings connecting said second connection pipe and said second flow rate controller;

a flow path change over unit for allowing, when said heat source unit side heat exchanger is operated as a condenser, a flow of a refrigerant from a refrigerant outlet side of said condenser only to said second connection pipe and a flow of the refrigerant from said first connection pipe only to said fourth-way valve side, and allowing, when said heat source unit side heat exchanger is operated as an evaporator, a flow of the refrigerant from said first connection pipe only to a refrigerant inlet side of said evaporator and a flow of the refrigerant from said four-way valve only to said second connection pipe; and a junction unit disposed between said heat source unit and said plurality of indoor units, said intermediate unit comprising said first branch joint, said second branch joint, said gas-liquid separator, said second flow rate controller, said third flow rate controller, said fourth flow rate controller, said first heat exchanging portion and said bypass pipes;

characterized by the provision of:

a first bypass circuit which is connected between said first connection pipe and said second connection pipe and which is opened during the defrosting operation, wherein said third flow rate controller disposed in said bypass pipe is opened during the defrosting operation.

* * * * *